US011058150B2

(12) United States Patent
Lopez

(10) Patent No.: US 11,058,150 B2
(45) Date of Patent: Jul. 13, 2021

(54) TOBACCO PRODUCT SCRAPER AND HOLDER

(71) Applicant: Massimiliano Lopez, Miami, FL (US)

(72) Inventor: Massimiliano Lopez, Miami, FL (US)

( * ) Notice: Subject to any disclaimer, the term of this patent is extended or adjusted under 35 U.S.C. 154(b) by 540 days.

(21) Appl. No.: 16/033,176

(22) Filed: Jul. 11, 2018

(65) Prior Publication Data

US 2020/0015518 A1 Jan. 16, 2020

(51) Int. Cl.

| | |
|---|---|
| ***A24F 13/12*** | (2006.01) |
| ***A24F 19/10*** | (2006.01) |
| ***A24F 13/14*** | (2006.01) |
| ***B65D 85/12*** | (2006.01) |
| ***B65D 43/02*** | (2006.01) |
| ***B65D 43/16*** | (2006.01) |
| ***B65D 21/02*** | (2006.01) |

(52) U.S. Cl.

CPC ..... *A24F 13/12* (2013.01); *A24F 13/14* (2013.01); *A24F 19/10* (2013.01); *B65D 21/0209* (2013.01); *B65D 43/0202* (2013.01); *B65D 43/162* (2013.01); *B65D 85/12* (2013.01)

(58) Field of Classification Search

CPC ..... B65D 85/10; B65D 85/12; B65D 85/1036–1063; B65D 21/0209; B65D 43/0202; B65D 43/162; A24F 19/0078; A24F 19/0085; A24F 13/12; A24F 13/14; A24F 13/16; A24F 15/00–20; A24F 19/10

USPC ..... 131/231, 233, 242; 232/43.1–43.5; 206/242, 246, 256, 257, 264, 496; 220/501

See application file for complete search history.

(56) References Cited

U.S. PATENT DOCUMENTS

| | | | | |
|---|---|---|---|---|
| 1,706,244 | A | 3/1929 | Meyerson | |
| 1,766,571 | A | 6/1930 | Weisberg | |
| 1,928,041 | A | 9/1933 | Windesheim | |
| 2,118,564 | A | 5/1938 | McCready | |
| 5,181,528 | A | 1/1993 | Chen et al. | |
| 2009/0314299 | A1 * | 12/2009 | Kilpatrick | A24F 19/10 131/187 |
| 2016/0262448 | A1 | 9/2016 | Zeitlin | |

FOREIGN PATENT DOCUMENTS

| | | | | |
|---|---|---|---|---|
| CN | 202967125 U | * | 6/2013 | B65D 81/18 |

OTHER PUBLICATIONS

CN-202967125-U (Machine Translation) [online], [retrieved on Feb. 19, 2021], retrieved from Google Patents (patents.google.com) (Year: 2013).*

* cited by examiner

*Primary Examiner* — Michael H. Wilson
*Assistant Examiner* — Yana B Krinker
(74) *Attorney, Agent, or Firm* — Pablo Meles; GrayRobinson, PA

(57) ABSTRACT

A tobacco scraper and container system such as a cigar scraper and container can include a first container having a closed bottom portion and an open top portion, a scraper element configured and arranged to be placed above the open top portion of the first container, and a removable cap configured to couple to the first container, enclose the first container, and to retain the scraper in a fixed position relative to the first container when coupled to the first container. In some embodiments, first container is configured to couple with a second container to enclose the second container when coupled with the closed bottom portion of the first container.

17 Claims, 3 Drawing Sheets

10

10

10

10

10

20

TOBACCO PRODUCT SCRAPER AND HOLDER

CROSS-REFERENCE TO RELATED APPLICATIONS

N/A

FIELD OF THE DISCLOSURE

The present disclosure generally relates to systems and methods in the field of tobacco product accessories, and more particularly relates to a tobacco product scraper and holder system.

BACKGROUND

Cigar holders are generally simply tubes that hold either brand new cigars or partially smoked cigars. A partially smoked cigar will typically include some ash even if the cigar is put out and the end is flicked away. Storage of a partially smoked cigar or unfinished cigar in a cigar holder will usually cause the ash to spread across the cigar wrapper or outer area over time as the remaining cigar is carried in the cigar holder. This may cause the user to have dirty or ashened hands or fingers when the cigar is retrieved again for smoking or holding.

DETAILED DESCRIPTION

Glossary of Terms

Figure 1:
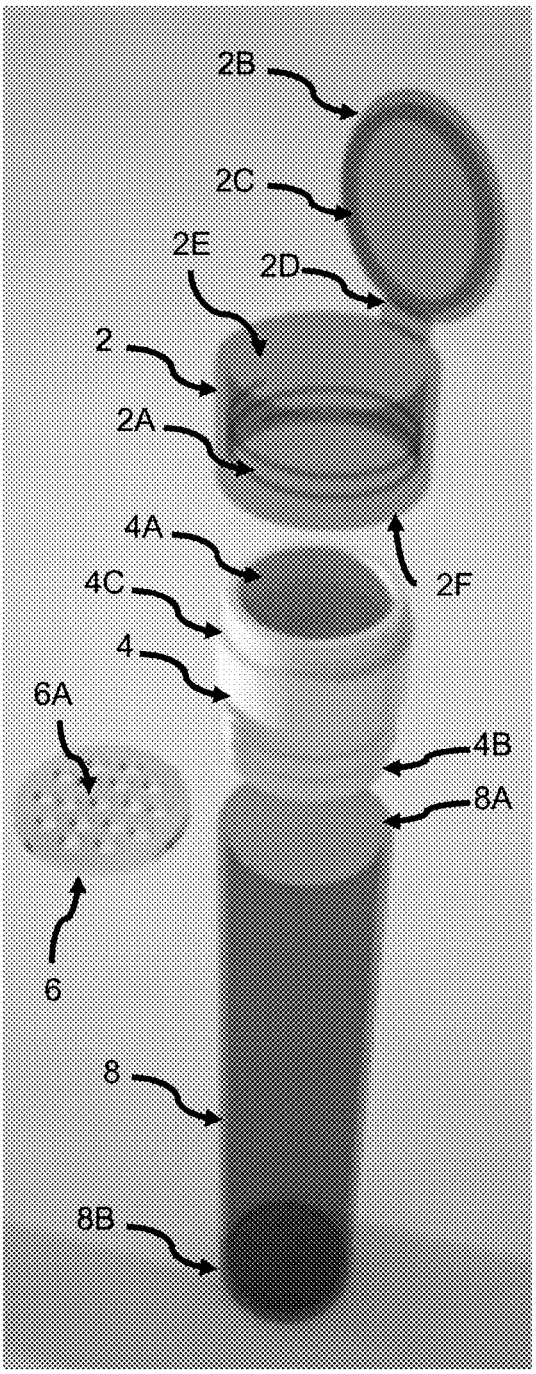
FIG. 1 illustrates an exploded view of a tobacco product scraper and holder according to one embodiment of the disclosure.

Cavity—is an empty space or volume.

A container is cavity that is capable of being enclosed, particularly when sealed or closed with a cap or lid.

Unitary piece—is a number of portions of an apparatus or device made from a single piece of material such as a single piece of molded or 3-D printed plastic or other material. A unitary piece can also include an apparatus or device that is double-shot molded.

A tobacco product generally refers to a cigar, a cigar stub, a cigarello, a cigarette, a cigarette stub, or any other smokable plant product filled wrapper or corresponding stub.

A stub is a portion of a tobacco product that remains unconsumed or unsmoked.

Ash is a remaining consumed portion of a tobacco product that falls off the tobacco product or that can be scraped off the tobacco product.

Described herein is a tobacco product scraper and holder or container system that can be embodied in numerous forms to accommodate various tobacco products. As tobacco products or other smokable products come in various forms, the shape of the scraper and container system can be modified in accordance with the embodiments to best suit one or more of the intended products. It will be apparent, however, to one skilled in the art that embodiments herein may be practiced without some or all of these specific details. In other instances, well known steps and/or structures have not been described in order to not unnecessarily obscure the embodiments of the paper roll cover.

Unless otherwise indicated, all numbers expressing quantities, conditions, and the like in the instant disclosure and claims are to be understood as modified in all instances by the term "about." The term "about" refers, for example, to numerical values covering a range of plus or minus 10% of the numerical value. The modifier "about" used in combination with a quantity is inclusive of the stated value.

In this specification and the claims that follow, singular forms such as "a", "an", and "the" include plural forms unless the content clearly dictates otherwise.

In some embodiments, portions of the tobacco scraper and holder or container system according to the present disclosure can include a first container having a closed bottom portion and an open top portion, a scraper element configured and arranged to be placed above the open top portion of the first container, and a removable cap configured to couple to the first container, enclose the first container, and to retain the scraper in a fixed position relative to the first container when coupled to the first container. In some embodiments, the system further includes a second container configured to couple with the first container and enclose the second container when coupled with the closed bottom portion of the first container.

In some embodiments, a tobacco product scraper and holder can include a cylindrical container having a closed bottom portion and an open top portion, a scraper element configured and arranged to be placed above the open top portion of the cylindrical container, and a removable cap configured to couple to the cylindrical container, enclose the container, and to retain the scraper in a fixed position relative to the cylindrical container when coupled to the cylindrical container. In some embodiments, the cigar scraper and holder further includes a second cylindrical container configured to couple with the cylindrical container and enclose the second cylindrical container when coupled with the closed bottom portion of the cylindrical container.

In some embodiments, a tobacco product scraper and holder includes a first cylindrical container having a closed bottom portion and an open top portion, a scraper element configured and arranged to be placed above the open top portion of the first cylindrical container, a removable cap configured to couple to the first cylindrical container, enclose the first cylindrical container, and to retain the scraper in a fixed position relative to the first cylindrical container when coupled to the first cylindrical container. The cigar scraper and holder can further include a second cylindrical container configured to couple with the first cylindrical container and enclose the second cylindrical container when coupled with the closed bottom portion of the first cylindrical container.

In some embodiments and referring to FIGS. 1-4, a tobacco product scraper and holder 10 can include various components that can serve to scrape ash from a partially consumed tobacco product, store the scraped ash in a separate container that is separate from the container where the remaining unconsumed tobacco product or stub would be stored. Although the typical tobacco product contemplated herein can be a cigar, the embodiments herein contemplate any smokable plant filled wrapper product and also contemplates the storage of one or more tobacco products and not just a single tobacco such as a single cigar. In some embodiments, the separate second container can be configured hold a bundle of cigars, cigarellos, or other tobacco products and in any combination of such tobacco products. The tobacco product scraper and holder 10 can include a first container 4 having a closed bottom portion 4B and an open top portion 4A. Product 10 can further include a scraper element 6 configured and arranged to be placed above the open top portion 4A of the first container 4. The scraper element 6 can be made of plastic or metal and can further include a plurality of holes or cavities 6A that can have sharp edges to serve as an effective scraper of cigar ash or other forms of ash. The product 10 can further include a removable cap 2 configured to couple to the first container 4, enclose the first container 4, and to retain the scraper element 6 in a fixed position relative to the first container 4 when coupled to the first container 4. In some embodiments, the tobacco product and scraper holder 10 can further include a second container 8 that is configured to couple with the first container 4 at a top opening 8A of the second contain 8 and enclose the second container 8 when coupled with the closed bottom portion 4B of the first container 4. The second container 8 has a closed bottom portion 8B. Thus, a closed container is formed between the closed bottom portion 8B and the the closed bottom portion 4B when the first container 4 and the second container 8 are coupled together.

The first container 4 can include one or more circumscribed mating features 4C on the top and/or bottom portions of the first container 4. The mating feature 4C can be a channel or ledge or a protrusion that would allow a corresponding channel or protrusion to mate with a mating feature 2A on the cap 2 for example which can be a corresponding channel, protrusion or ridge or ledge. The first container 4 can have a similar mating feature (not shown) towards the bottom of the first container 4 allowing the first container to mate with the second container. In some embodiments, the mating feature is not used and the corresponding parts can couple together with a press fit between the parts. Note that the mating features 2A and 4C can also correspond to what is used on a screw top allowing the separate parts to couple by turning or screwing in the parts relative to each other and similarly disassembling the parts by unscrewing. In some embodiments, respective portions of the mating features can include threads or other similar elements that allow mating with some amount of relative rotation.

Figure 2:
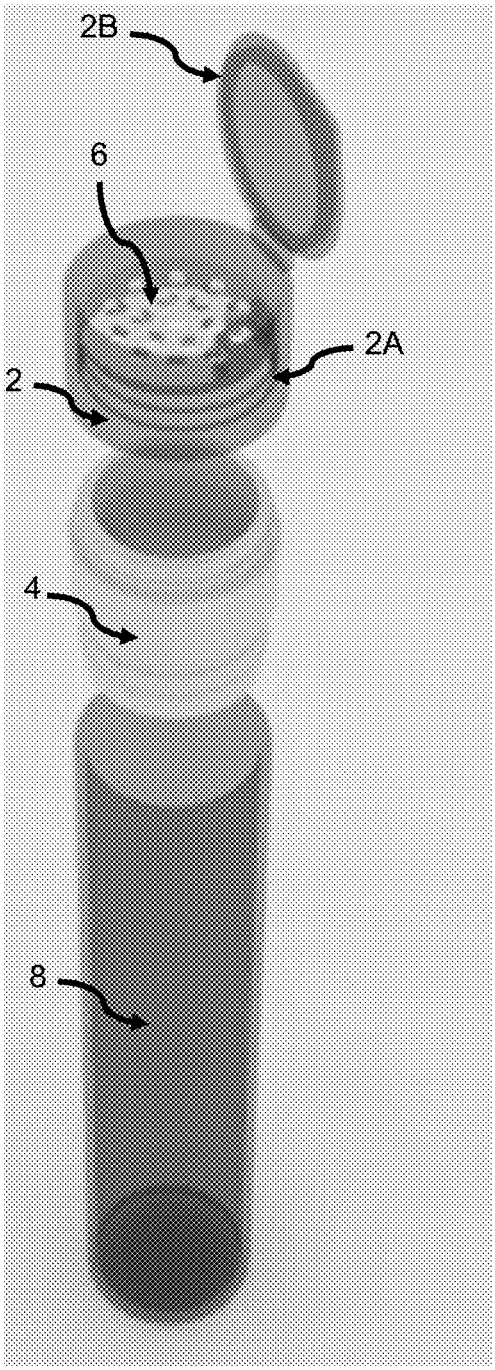
FIG. 2 illustrates a partially exploded view of the tobacco product scraper and holder of FIG. 1 in accordance with one embodiment of the disclosure.
Figure 5:
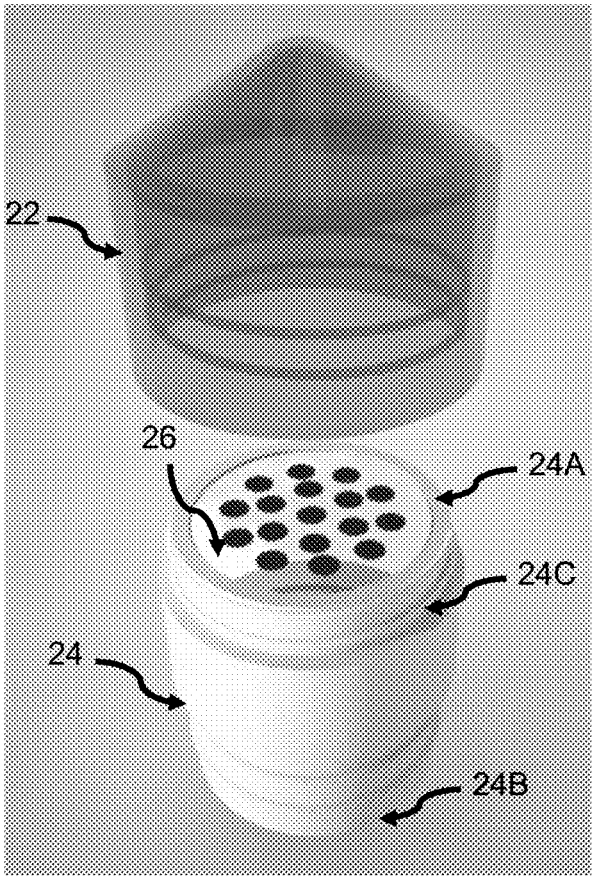
FIG. 5 illustrates a close up view of top portions of a tobacco product scraper and holder in accordance with another embodiment of the disclosure.

In some embodiments, the cap 2 can be a unitary piece part that essentially forms a lid to close or seal the first contain 4. In some embodiments, the cap 2 can include top open portion 2E and a bottom open portion 2F. The top open portion 2E can be selectively closed using a pop-up top or lid 2B that is optionally coupled to the main portion of the cap 2 via a hinge 2D. The lid 2B can include an interior lip 2C around or about the circumference of the lid 2B that helps seal the top portion 2E of the cap 2. In some embodiments, the scraper element 6 can be placed through the top portion 2E of the cap 2 and set in place with one or more mating features 2A in the cap 2 as shown in FIG. 2. Similarly, the scraper element 6 can be placed through the bottom portion 2F of the cap and set in place with the mating feature 2A as shown in FIG. 2. Thus, the cap 2 can be a removable cap that includes a pop-up top that is hinged to a top portion of the removable cap. In some embodiments, as might be best illustrated by the container and cap combination 20 of FIG. 5, the combination 20 can include a container 24 having a closed bottom portion 24B and a open top portion 24A, and a mating feature 24C. The mating feature 24 aids in mating the cap 22 with the container 24 when placed together. A scraper element 26 can reside on the open top portion 24A of the container 24. In one embodiment, the scraper element 26 can lay flush with the open top portion of the first container 24. The entire cap 22 can pop on and off from the container 24 and serve to contain any ashes that were scraped into the container 24.

Figure 3:
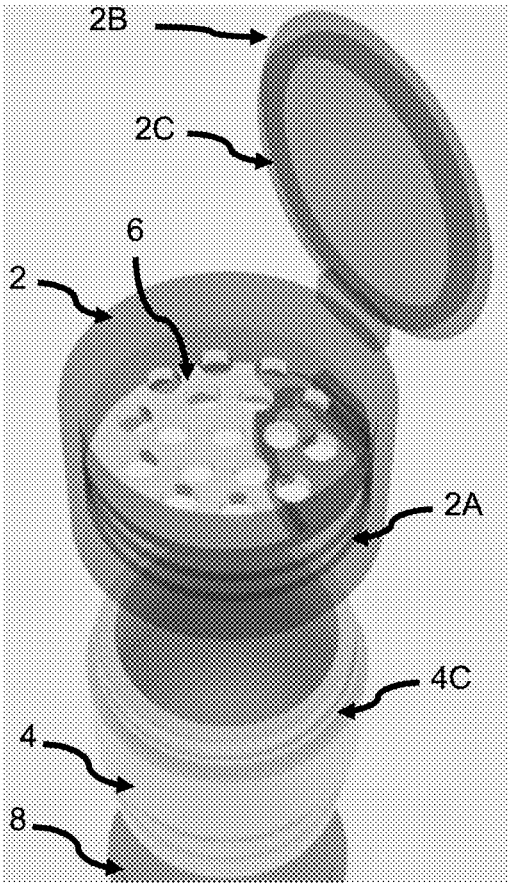
FIG. 3 illustrates a close up view of the top portions of the tobacco product scraper and holder of FIGS. 1 and 2 in accordance with one embodiment of the disclosure.

FIG. 3 illustrates a close-up of an upper portion of the tobacco product scraper and holder 10 including a top part of the second container 8, the first container 4 with its mating feature 4C, the cap 2 with mating feature 2A, lid 2B, and lip 2C, as well as the scraper element 6. As shown, the mating feature 2A can be a single channel or multiple channels or indentations that can receive the edge of the scraper element 6 in one channel and a protrusion (such as mating element 4C) on the first container 4 on either the same channel or a separate channel that forms the mating feature 2A.

Note that the first container and/or the second container can have any number of shapes for holding the tobacco products. Generally, most embodiments will be cylindrically shaped but other shapes are contemplated including, but not limited to shapes that include multiple sides such as hexagonal type shapes or star shapes.

Figure 4:
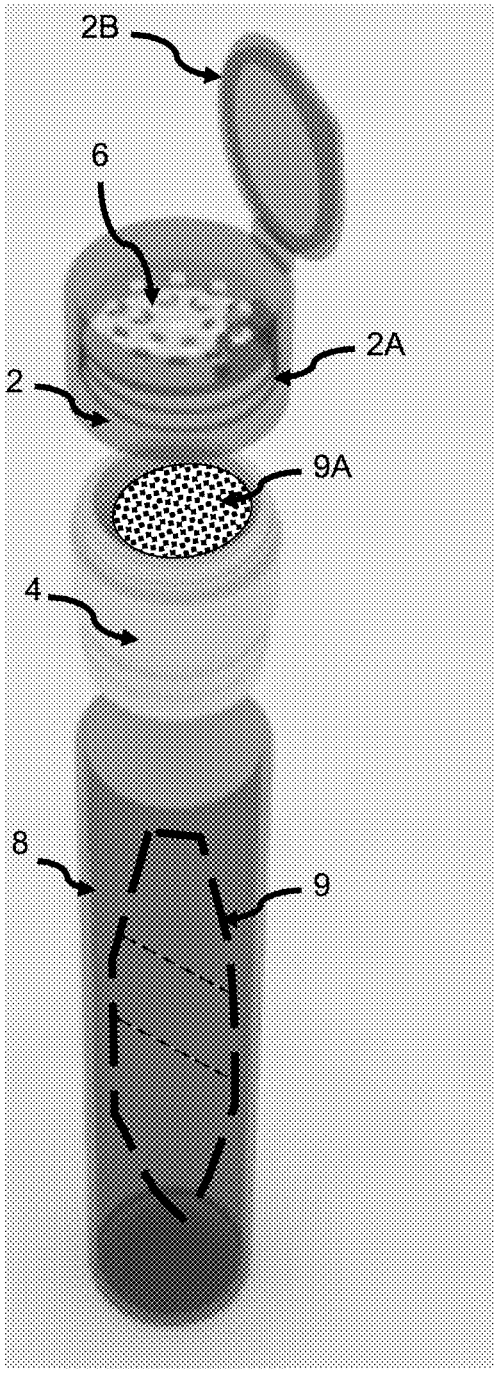
FIG. 4 illustrates the tobacco product scraper and holder of FIG. 2 including ash in a first container and a cigar stub in a second container in accordance with an embodiment.

Referring to the cigar scraper and holder 10 of FIG. 4, further note that the scraper element 6 is configured to scrape ash from a cigar 9 (shown within the second cylindrical container 8) when the removable cap 2 is in an open position (as shown with lid 2B open) or when the entire cap 2 is removed and where the first cylindrical container 4 and removable cap 2 are configured to retain ash 9A in the first cylindrical container 4 when the first cylindrical container 4 and removable cap 2 are coupled in a closed position. In other words, the scraper element 6 is configured to scrape ash 9A from a cigar 9 when the removable cap 2 is in an open position or removed and the first cylindrical container 4 is configured to retain ash in the first cylindrical container 4 when the cylindrical container 4 and removable cap 2 are coupled in a closed position, and the second cylindrical container 8 is configured to retain a cigar or cigar stub (9) free from ash 9A retained in the first cylindrical container 4. In this manner, a previously used cigar or other tobacco product or stub (9) can be stored away in the second container 8 without any contamination from the ash 9A that was previously removed or scraped away from the cigar, tobacco product or stub 9.

In some embodiments, the tobacco product scraper and holder can be formed by using 3 dimensional printing or a 3-D printer. In other embodiments, the tobacco product scraper and holder can be formed using a molding process such as single shot or double shot molding. In some embodiments, portions of the tobacco product scraper and holder can be made of plastic, metal, stone, glass, plexiglass, wood, or any combination thereof. In some embodiments, all the elements or some of the elements such as the cap, or first container, or second container can be made of a metal such as aluminum, stainless steel, or even a precious metal or alloy. Any combination of materials are contemplated for use with the various elements recited in the claims.

It will be appreciated by those skilled in the art that the present invention can be embodied in other specific forms without departing from the spirit or essential characteristics thereof. The presently disclosed embodiments are therefore considered in all respects to be illustrative and not restricted. Modifications and variations are possible in light of the above teachings or may be acquired from practicing of the disclosure, without departing from the breadth or scope.

What is claimed is:

1. A tobacco product scraper and holder, comprising:

a cylindrical container having a closed bottom portion and an open top portion;

a scraper element configured and arranged to be placed above the open top portion of the cylindrical container;

a removable cap configured to couple to the cylindrical container, enclose the container, and to retain the scraper in a fixed position relative to the cylindrical container when coupled to the cylindrical container; and a second cylindrical container configured to couple with the cylindrical container and enclose the second cylindrical container when coupled with the closed bottom portion of the cylindrical container.

2. The tobacco product scraper and holder of claim 1, wherein the cylindrical container and removable cap are made of plastic or polyurethane.

3. The tobacco product scraper and holder of claim 1, wherein the scraper element is made of metal.

4. The tobacco product scraper and holder of claim 1, wherein the removable cap further comprises a pop-up top that is hinged to a top portion of the removable cap.

5. The tobacco product scraper and holder of claim 1, wherein the removable cap further includes at least one interior ridge for retaining the scraper element and for mating with an exterior mating element on the cylindrical container.

6. The tobacco product scraper and holder of claim 1, wherein the scraper element is configured to reside within the removable cap and above the open top portion of the cylindrical container when the removable cap is coupled to the cylindrical container.

7. The tobacco product scraper and holder of claim 1, wherein the scraper element is configured to lay flush with the open top portion of the cylindrical container.

8. The tobacco product scraper and holder of claim 1, wherein the scraper element is configured to scrape ash from a tobacco product when the removable cap is in an open position or removed and wherein the cylindrical container and removable cap are configured to retain ash in the cylindrical container when the cylindrical container and removable cap are coupled in a closed position.

9. The tobacco product scraper and holder of claim 1, wherein the scraper element is configured to scrape ash from a cigar when the removable cap is in an open position or removed, the cylindrical container and removable cap are configured to retain ash in the cylindrical container when the cylindrical container and removable cap are coupled in closed position, and the second cylindrical container is configured to retain a cigar or cigar stub free from ash retained in the cylindrical container.

10. A tobacco product scraper and holder, comprising:

a scraper element configured and arranged to be placed above an open top portion of a first container having a closed bottom portion and the open top portion;

a removable cap configured to couple to the first container, enclose the first container, and to retain the scraper in a fixed position relative to the first container when coupled to the first container; and a second container configured to couple with the first container and enclose the second container when coupled with the closed bottom portion of the first container.

11. The tobacco product scraper and holder of claim 10, wherein the removable cap further comprises a pop-up top that is hinged to a top portion of the removable cap.

12. The tobacco product scraper and holder of claim 10, wherein the removable cap further includes at least one interior ridge for retaining the scraper element and for mating with an exterior mating element on the first container.

13. The tobacco product scraper and holder of claim 10, wherein the scraper element is configured to reside within the removable cap and above the open top portion of the first container when the removable cap is coupled to the cylindrical container.

14. The tobacco scraper and holder of claim 10, wherein the scraper element is configured to lay flush with the open top portion of the first container.

15. A cigar scraper and holder, comprising:

a first cylindrical container having a closed bottom portion and an open top portion;

a scraper element configured and arranged to be placed above the open top portion of the first cylindrical container;

a removable cap configured to couple to the first cylindrical container, enclose the first cylindrical container, and to retain the scraper in a fixed position relative to the first cylindrical container when coupled to the first cylindrical container; and a second cylindrical container configured to couple with the first cylindrical container and enclose the second cylindrical container when coupled with the closed bottom portion of the first cylindrical container.

16. The cigar scraper and holder of claim 15, wherein the scraper element is configured to scrape ash from a cigar when the removable cap is in an open position or removed and wherein the cylindrical container and removable cap are configured to retain ash in the cylindrical container when the first cylindrical container and removable cap are coupled in a closed position.

17. The cigar scraper and holder of claim 15, wherein the scraper element is configured to scrape ash from a cigar when the removable cap is in an open position or removed, the first cylindrical container and removable cap are configured to retain ash in the first cylindrical container when the cylindrical container and removable cap are coupled in a closed position, and the second cylindrical container is configured to retain a cigar or cigar stub free from ash retained in the first cylindrical container.

* * * * *